US007892042B2

(12) United States Patent
Spicer et al.

(10) Patent No.: US 7,892,042 B2
(45) Date of Patent: Feb. 22, 2011

(54) CONNECTOR WITH KEYING MEMBER

(75) Inventors: Michael John Spicer, Lancaster, PA (US); Daniel Eugene Stahl, Middletown, PA (US); Stephen Daniel Gherardini, Harrisburg, PA (US); Keith Edwin Miller, Manheim, PA (US); John Kevin Knoll, Lebanon, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/503,652

(22) Filed: Jul. 15, 2009

(65) Prior Publication Data

US 2011/0014809 A1 Jan. 20, 2011

(51) Int. Cl.
*H01R 13/64* (2006.01)

(52) U.S. Cl. ..... 439/681; 439/680

(58) Field of Classification Search ..... 439/374, 439/889, 133, 304, 680–681
See application file for complete search history.

(56) References Cited

U.S. PATENT DOCUMENTS 3,143,384 A 8/1964 Senior, Jr.
3,226,667 A 12/1965 Senior, Jr.
4,056,298 A * 11/1977 Cooper et al. ..... 439/311
4,173,349 A 11/1979 Neale, III
4,183,605 A * 1/1980 Arneson ..... 439/311
4,277,125 A * 7/1981 Ball ..... 439/311
4,531,798 A * 7/1985 Baur et al. ..... 439/368
4,597,620 A 7/1986 Lindner et al.
4,695,110 A 9/1987 Wasserlein
4,702,539 A 10/1987 Cusick, III et al.
5,017,161 A 5/1991 Hauchard et al.
5,346,406 A * 9/1994 Hoffman et al. ..... 439/474
5,366,392 A 11/1994 Raloff et al.
5,521,997 A * 5/1996 Rovenolt et al. ..... 385/77
5,681,187 A 10/1997 Fukushima et al.
5,685,727 A * 11/1997 Cairns ..... 439/139
5,685,730 A 11/1997 Cameron et al.
6,309,231 B1 10/2001 Gordon et al.
7,097,514 B2 * 8/2006 Ishizaki et al. ..... 439/681
7,481,584 B2 * 1/2009 Cairns ..... 385/60
2006/0199411 A1 9/2006 Singh et al.

* cited by examiner

*Primary Examiner*—Michael C Zarroli

(57) ABSTRACT

A connector is provided for terminating an end portion of a cable that includes a conductor. The connector includes a housing and a contact held by the housing. The contact is configured to be connected to the conductor of the cable. A keying member is rotatably held by the housing. The keying member is configured to cooperate with a keying element of a mating connector that mates with the connector. The keying member is movable about the housing such that the keying member is rotatably positioned to align with the keying element of the mating connector.

18 Claims, 5 Drawing Sheets

CONNECTOR WITH KEYING MEMBER

BACKGROUND OF THE INVENTION

The subject matter described and/or illustrated herein relates generally to connectors, and more particularly, to connectors having keying members for orienting the connector relative to a mating connector.

Connectors that terminate the end of a cable, or cable connectors, typically mate with the mating connector of another device, for example another cable. The cable connector includes a housing that holds one or more contacts. Each contact is connected to a corresponding conductor that extends along the length of the cable. When the housing of the cable connector is mated with a housing of the mating connector, each of the contacts engages a corresponding mating contact of the mating connector to establish a connection between the cable and the other device. The housings of the cable and mating connectors sometimes include keying elements, which may also be referred to as keying members. The keying members/elements cooperate such that the cable connector can only be mated with the mating connector of the device to which the cable is to be connected. Accordingly, the keying members/elements may prevent the cable from being connected to the wrong device.

The keying members/elements cooperate such that the cable and mating connectors can only be mated together in a predetermined relative orientation. In other words, the keying members/elements prevent the cable and mating connectors from being mated together when the housings are not in the predetermined orientation relative to each other. To mate the cable and mating connectors together, the housings must be aligned into the predetermined relative position. For example, the keying members/elements may be aligned by rotating the housing of the cable connector relative to the mating connector. However, rotating the housing of the cable connector may damage the cable connector. For example, rotating the housing of the cable connector may damage the housing and/or may disengage the contact(s) of the cable connector from the conductor(s) of the cable and thereby interrupt connection therebetween. Moreover, and for example, rotating the housing of the cable connector may twist the cable. Twisting the cable may make it more difficult to rotate and/or hold the housing of the cable connector in the predetermined relative orientation, which may make it more difficult to mate the cable connector to the mating connector. Further, twisting the cable may damage and/or sever the conductor of the cable.

BRIEF DESCRIPTION OF THE INVENTION

In one embodiment, a connector is provided for terminating an end portion of a cable that includes a conductor. The connector includes a housing and a contact held by the housing. The contact is configured to be connected to the conductor of the cable. A keying member is rotatably held by the housing. The keying member is configured to cooperate with a keying element of a mating connector that mates with the connector. The keying member is movable about the housing such that the keying member is rotatably positioned to align with the keying element of the mating connector.

In another embodiment, a connector and cable assembly includes a cable including an end portion and a conductor extending along a length of the cable, and a connector terminating the end portion of the cable. The connector includes a housing and a contact held by the housing. The contact is connected to the conductor of the cable. A keying member is rotatably held by the housing. The keying member is configured to cooperate with a keying element of a mating connector that mates with the connector. The keying member is movable about the housing such that the keying member is rotatably positioned to align with the keying element of the mating connector.

In another embodiment, a connector assembly includes a mating connector having a mating connector housing including a keying element, and a cable connector including a cable connector housing and a keying member rotatably held by the cable connector housing. The keying member and the keying element are configured to cooperate with each other to enable the cable connector and the mating connector to be mated together. The keying member is rotatably movable about the cable connector housing such that the keying member is rotatably positioned to align with the keying element of the mating connector.

DETAILED DESCRIPTION OF THE INVENTION

Figure 1:
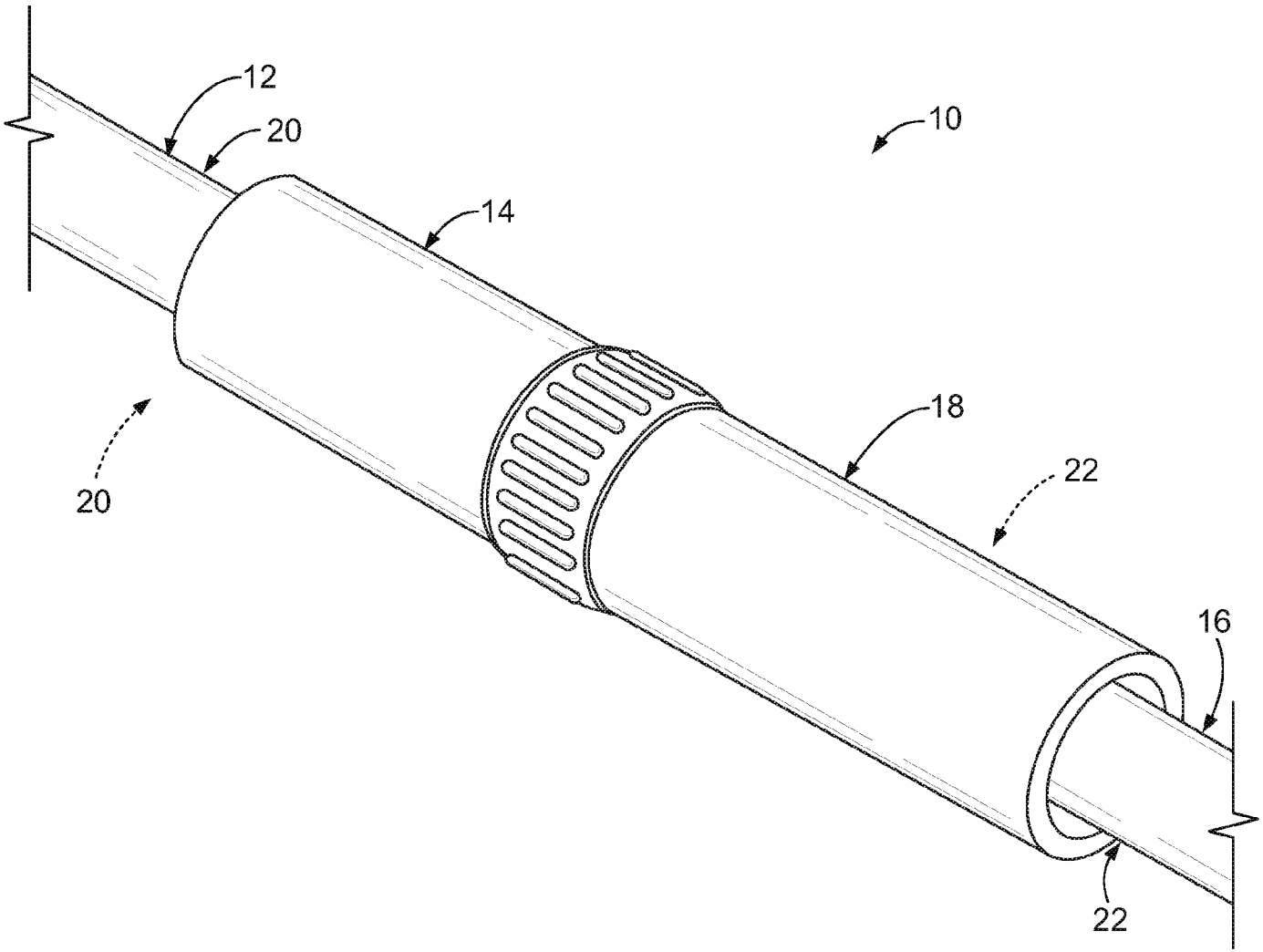
FIG. 1 is a perspective view of an exemplary embodiment of an electrical connector assembly illustrating the assembly in a mated state.

FIG. 1 is a perspective view of an exemplary embodiment of an electrical connector assembly 10 illustrating the assembly 10 in a mated state. The assembly 10 includes an electrical cable 12, a cable connector 14, an electrical cable 16, and a mating connector 18. The cable connector 14 terminates an end portion 20 of the electrical cable 12. In the exemplary embodiment, the mating connector 18 terminates an end portion 22 of the electrical cable 16. Alternatively, the assembly 10 does not include the electrical cable 12 and the mating connector 18 terminates, and/or is electrically connected to, any other electrical device (not shown) and/or the like besides a cable. As will be described below, when the cable and mating connectors 14 and 18, respectively, are mated together as shown in FIG. 1, electrical connection between the connectors 14 and 18 establishes an electrical connection between the electrical cables 12 and 16. A combination of the electrical cable 12 and the cable connector 14 may be referred to herein as a "connector and cable assembly".

Figure 2:
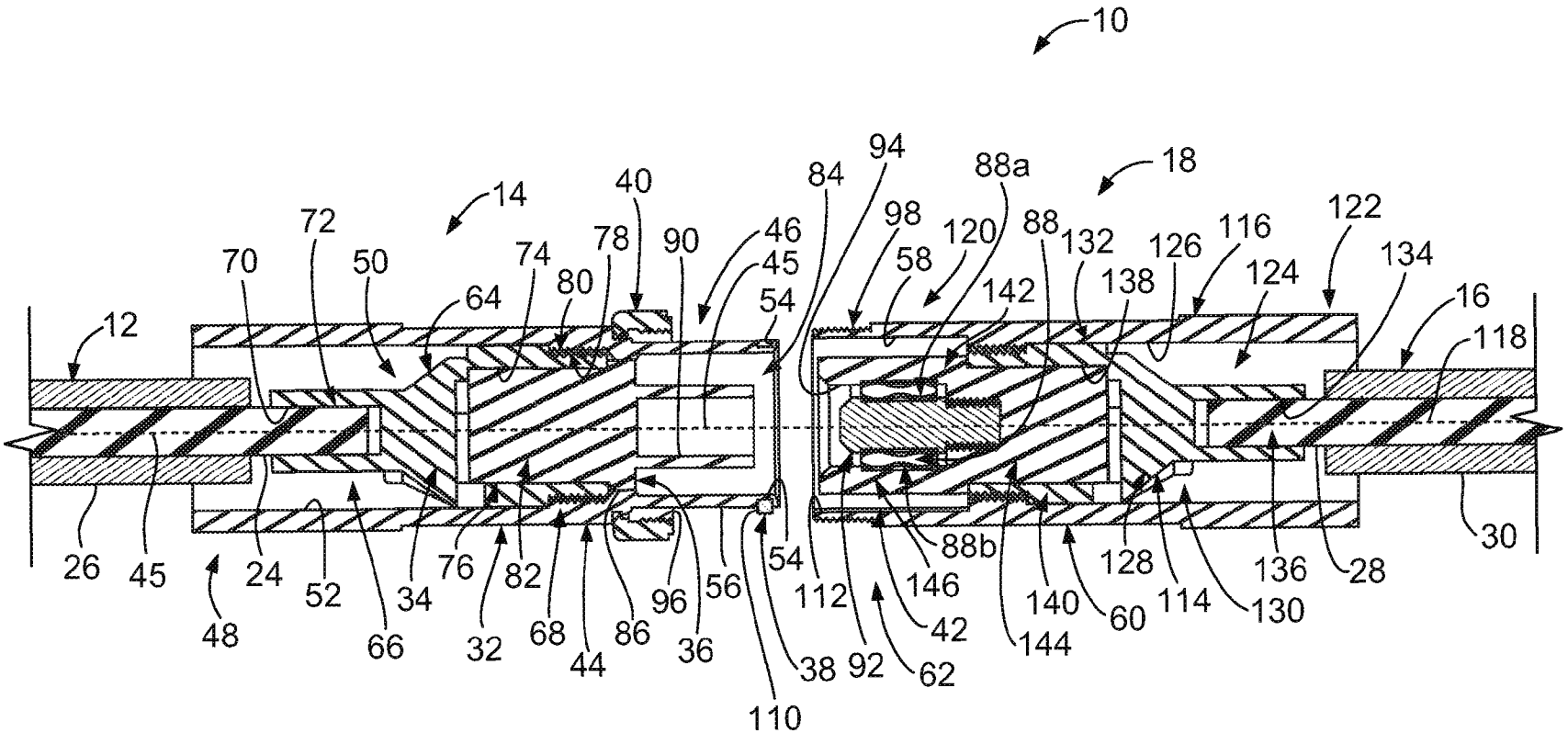
FIG. 2 is a cross-sectional view of the electrical connector assembly shown in FIG. 1 illustrating the assembly in an unmated state.

FIG. 2 is a cross-sectional view of the electrical connector assembly 10 illustrating the assembly 10 in an unmated state. The electrical cable 12 includes one or more electrical conductors 24 that extend along a length of the cable 12 and an insulating jacket 26 that surrounds the electrical conductor 24. Similarly, the electrical cable 16 includes one or more electrical conductors 28 that extend along a length of the cable 16 and an insulating jacket 30 that surrounds the electrical conductor 28. In the exemplary embodiment, each of the electrical cables 12 and 16 includes one electrical conductor 24 and 28, respectively, that conducts electrical power. However, each electrical cable 12 and 16 may include any number of electrical conductors 24 and 28, respectively, that each may conduct electrical power, electrical signals, or electrical ground. Moreover, although the electrical conductors 24 and 28 are each shown herein as including only a single strand, each of the electrical conductors 24 and 28 may include a plurality of strands. In some alternative embodiments, the electrical cables 12 and 16 may be replaced with cables (not shown) that each include one or more conductors (not shown) that conduct something other than electrical power, electrical signals, and electrical ground, such as, but not limited to, optical cables that each include one or more optical conductors. Moreover, in some alternative embodiments, the electrical cables 12 and 16 may be replaced with cables (not shown) that each include one or more conduits (not shown), instead of conductors, that channel fluid. In such an alternative embodiment wherein the cables 12 and 16 are replaced with cables that include conduits instead of conductors, the connectors 14 and 18 include fittings (not shown) that mate together to establish a fluid connection between the conduits of the cables.

The cable connector 14 includes a housing 32, a wire barrel 34, an electrical contact 36, a keying member 38, and an optional fastener 40. As will be described below, the keying member 38 is configured to cooperate with a keying element 42 of the mating connector 18 to enable the connectors 14 and 18 to be mated together. The housing 32 includes a dielectric body 44 extending a length along a central longitudinal axis 45 from a mating end portion 46 to a cable end portion 48. A cavity 50 extends through the housing body 44 from the mating end portion 46 to the cable end portion 48. The cavity 50 is at least partially defined by an interior surface 52 of the housing body 44 that extends from the mating end portion 46 to the cable end portion 48. An optional wire seal (not shown) is received within the cavity 50 of the housing body 44 at the cable end portion 48 for sealing the cavity 50 at the cable end portion 48. Specifically, the wire seal engages the electrical cable 12 and the interior surface 52 of the housing body 44 to seal the electrical cable 12 to the housing 32 at the cable end portion 48 thereof. The housing 32 may be referred to herein as a "cable connector housing".

The mating end portion 46 of the housing body 44 includes an optional groove 54 that extends into an exterior surface 56 of the housing body 44. As will be described below, at least a portion of the keying member 38 is held within the groove 54. In the exemplary embodiment, the mating end portion 46 of the housing body 44 defines a plug that is configured to be received within an opening 58 of a housing 60 of the mating connector 18. Alternatively, the mating end portion 46 of the housing body 44 includes an opening (not shown) that receives at least a portion of a mating end portion 62 of the mating connector housing 60 therein. The cable connector 14 optionally includes a seal member (not shown) that extends around the exterior surface 56 of the housing body 44 between the housing body 44 and the fastener 40. The optional seal member that extends around the exterior surface 56 engages the mating end portion 62 of the mating connector housing 60 when the connectors 14 and 18 are mated together to facilitate sealing the interface between the mating end portions 46 and 62.

The wire barrel 34 is held within the cavity 50 of the housing body 44 and includes an electrically conductive body 64 that extends from a cable end portion 66 to a contact end portion 68. The cable end portion 66 of the wire barrel 34 includes an opening 70 that receives an end portion 72 of the electrical conductor 24 therein such that the electrical conductor 24 is electrically connected to the wire barrel 34. The wire barrel 34 may be electrically and mechanically connected to the electrical conductor 24 using any structure, method, means, connection type, configuration, arrangement, and/or the like. In the exemplary embodiment, the cable end portion 66 of the wire barrel 34 is crimped about the end portion 72 of the electrical conductor 24 to electrically and mechanically connect the electrical conductor 24 to the wire barrel 34.

The contact end portion 68 of the wire barrel 34 includes an opening 74 that receives an end portion 76 of the electrical contact 36 therein. The wire barrel 34 may be held in the cavity 50 of the housing 32 using any structure, method, means, connection type, configuration, arrangement, and/or the like, such as, but not limited to, a snap fit connection, an interference (or clearance) fit connection, using any fastener(s) and/or any fastener element(s), and/or the like. In the exemplary embodiment, the contact end portion 68 of the wire barrel 34 includes a fastener element, or more specifically a thread 78, that engages a thread 80 of the interior surface 52 of the housing body 44 to hold the wire barrel 34 within the housing cavity 50.

The electrical contact 36 is held within the cavity 50 of the housing body 44 and includes an electrically conductive body 82 that extends from the end portion 76 to a mating end portion 84. The end portion 76 of the electrical contact 36 is held within the opening 74 of the wire barrel 34 such that the mating end portion 84 of the electrical contact 36 extends along the mating end portion 46 of the housing body 44. The end portion 76 of the electrical contact 36 may be held in the opening 74 of the wire barrel 34 using any structure, method, means, connection type, configuration, arrangement, and/or the like, such as, but not limited to, a snap fit connection, an interference (or clearance) fit connection, using any fastener(s) and/or any fastener element(s), welding, brazing, and/or the like. In the exemplary embodiment, the end portion 76 of the electrical contact 36 is brazed to the wire barrel 34 to hold the end portion 76 of the electrical contact 36 within the opening 74 of the wire barrel 34. In addition or alternatively to the connection between the electrical contact 36 and the wire barrel 34, the electrical contact 36 may be connected to the housing body 44 using any structure, method, means, connection type, configuration, arrangement, and/or the like, such as, but not limited to, a snap fit connection, an interference (or clearance) fit connection, using any fastener(s) and/or any fastener element(s), welding, brazing, and/or the like. In the exemplary embodiment, the electrical contact 36 includes a flange 86 that engages the interior surface 52 of the housing body 44.

As described above, the mating end portion 84 of the electrical contact 36 extends within the cavity 50 along the mating end portion 46 of the housing body 44. The mating end portion 84 of the electrical contact 36 is configured to engage an electrical contact 88 of the mating connector 18 to establish an electrical connection between the connectors 14 and 18. As will be described below, the mating end portion 84 of the electrical contact 36 includes an optional opening 90 that receives a portion **88*a* of the electrical contact 88 and an optional support pin 92 of the mating connector 18 therein. In the exemplary embodiment, the mating end portion 84 of the electrical contact 36 defines a plug that is configured to be received within a receptacle 94 of the mating connector 18. However, the electrical contact 36 may include any other size, shape, geometry, configuration, arrangement, structure, and/or the like that enables the electrical contact 88 to electrically connect to the electrical contact 36 of the cable connector 14**.

In the exemplary embodiment, the cable connector 14 includes one electrical contact 36 that conducts electrical power. However, the cable connector 14 may include any number of electrical contacts 36 that each may conduct electrical power, electrical signals, or electrical ground. In some alternative embodiments, the electrical contact(s) 36 may be replaced with one or more contacts that conduct something other than electrical power, electrical signals, and electrical ground, such as, but not limited to, one or more optical contacts.

The fastener 40 facilitates mechanically holding the cable connector housing 32 and the mating connector housing 60 together. The fastener 40 may be any type of fastener and/or fastener element. In the exemplary embodiment, the fastener 40 is a nut that is rotatably mounted on the exterior surface 56 of the housing body 44. The fastener 40 includes a thread 96 that engages a fastener element 98 of the mating connector housing 60 to mechanically connect the housings 32 and 60 together. In addition or alternative to the fastener 40, the housing 32 may include any other structure, method, means, connection type, configuration, arrangement, and/or the like for mechanical connection to the mating connector housing 60, such as, but not limited to, a snap fit connection, an interference (or clearance) fit connection, using any fastener(s) and/or any fastener element(s), and/or the like. In some alternative embodiments, the housings 32 and 60 do not include the fastener 40 or any other type of fastener or fastener element for mechanically connecting the housings 32 and 60 together.

Figure 3:
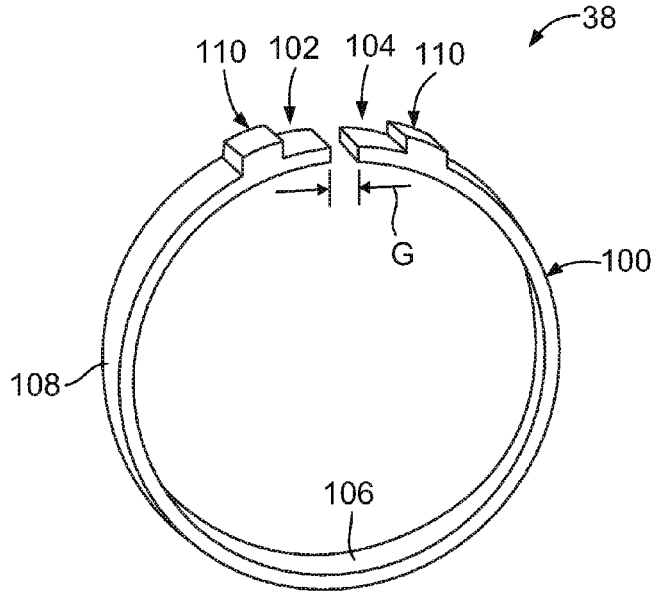
FIG. 3 is a perspective view of an exemplary embodiment of a keying member of the electrical connector assembly shown in FIGS. 1 and 2.

FIG. 3 is a perspective view of an exemplary embodiment of the keying member 38. The keying member 38 includes a body 100 extending from an end portion 102 to an end portion 104. In the exemplary embodiment, the keying member body 100 generally has the shape of a ring, wherein the end portions 102 and 104 oppose each other and are spaced apart by a gap G. Alternatively, the keying member body 100 may include any other size, shape, geometry, and/or the like, such as, but not limited to, embodiments wherein the housing 32 (FIGS. 2 and 4-6) has a different size, shape, geometry, and/or the like than is described and/or illustrated herein. In some alternative embodiments, the end portions 102 and 104 are connected such that the ring is continuous.

The keying member body 100 includes a radially inner surface 106 and a radially outer surface 108. In the exemplary embodiment, the radially outer surface 108 includes a pair of extensions 110 that extend radially outward. As will be described below, the extensions 110 are configured to cooperate with the keying element 42 (FIGS. 2, 5, and 6) of the mating connector 18 (FIGS. 1, 2, and 4-6) to enable the connectors 14 (FIGS. 1, 2 and 4-6) and 18 to be mated together. Specifically, each extension 110 is configured to be received within a corresponding opening 112 (FIGS. 2, 5, and 6) of the keying element 42.

Although shown as generally rectangular, each extension 110 may include any other size, shape, geometry, and/or the like, which may or may not be complementary with the corresponding opening 112 of the keying element 42. In the exemplary embodiment, each of the end portions 102 and 104 includes one of the corresponding extensions 110. However, each extension 110 may extend from any other location on the keying member body 100. Although two extensions 110 are shown, the keying member 38 may include any number of extensions 110 for reception within any number of openings 112 of the keying element 42. In addition or alternative to the extension 110, the keying member 38 may include any other structure, means, and/or the like that enables the keying member 38 to cooperate with any type of the keying element 42. For example, in addition or alternatively, the keying member body 100 may include one or more openings (not shown) that each receives one or more extensions (not shown) of the keying element 42 of the mating connector 18.

Figure 4:
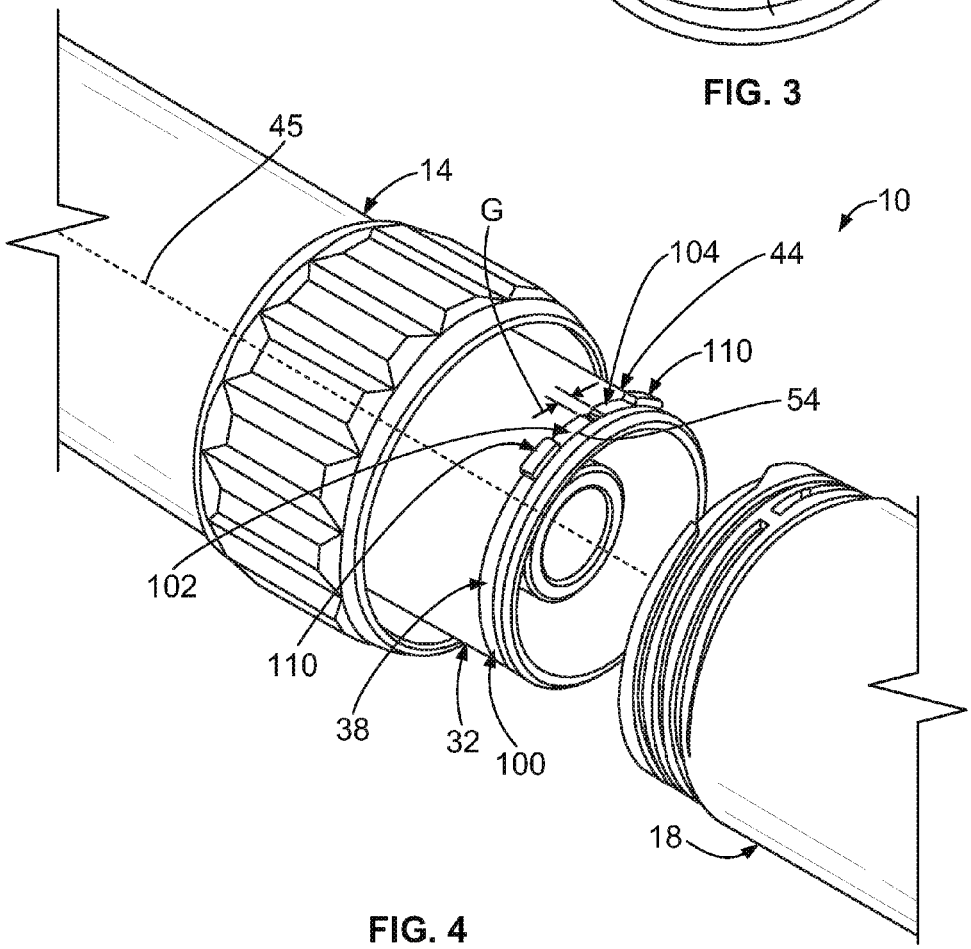
FIG. 4 is a perspective view of a portion of the electrical connector assembly shown in FIGS. 1 and 2 illustrating the assembly in the unmated state.
Figure 5:
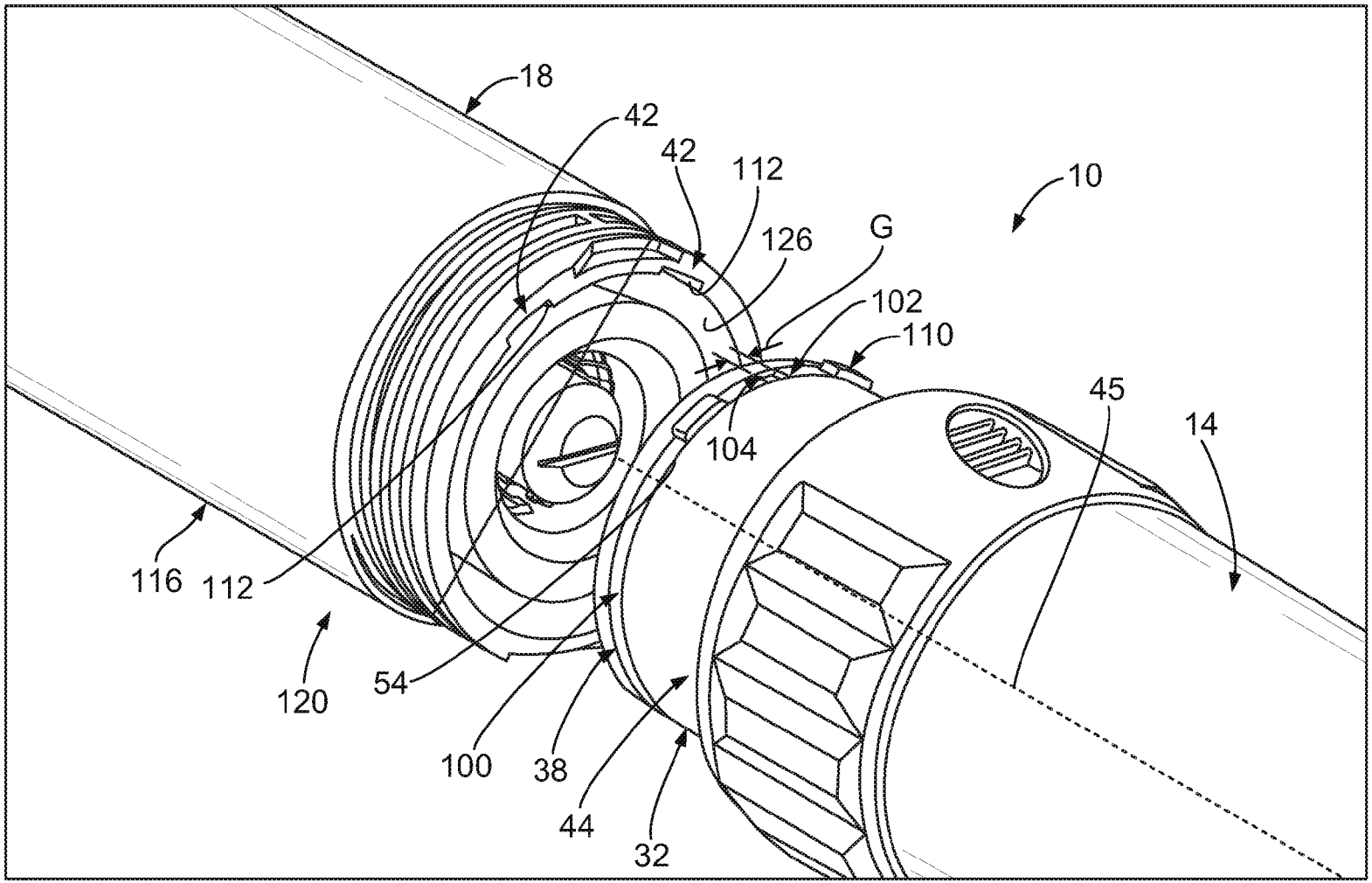
FIG. 5 is another perspective view of a portion of the electrical connector assembly shown in FIGS. 1, 2, and 4 taken from a different angle than FIG. 4.

FIG. 4 is a perspective view of a portion of the electrical connector assembly 10 illustrating the assembly 10 in the unmated state. FIG. 5 is another of a portion of the electrical connector assembly 10 taken from a different angle than FIG. 4. FIGS. 4 and 5 illustrate the keying member 38 mounted on the housing 32 of the cable connector 14. The keying member 38 is rotatably held by the housing 32 of the cable connector 14 such that the keying member body 100 is movable about the housing 32. Accordingly, the keying member 38 can be rotatably positioned about the circumference of the housing 32 to align with the keying element 42 (not visible in FIG. 4) of the mating connector 18. Specifically, in the exemplary embodiment at least a portion of the keying member body 100 is received within the groove 54 of the housing 32 such that the keying member body 100 surrounds at least a portion of the circumference of the housing body 44. The keying member body 100 is sized, shaped, and/or the like relative to the groove 54 such that the keying member body 100 is moveable within the groove 54. The keying member body 100 is thereby rotatable about the central longitudinal axis 45 of the housing 32 such that the extensions 110 can be rotatably positioned about the circumference of the housing 32 to align with the corresponding openings 112 (not visible in FIG. 4) of the keying element 42 and thereby enable the connectors 14 and 18 to be mated together.

As described above, the groove 54 within the housing 32 is optional. In embodiments wherein the housing 32 does not include the groove 54, the keying member 38 may be held by the housing 32 using any other structure, method, means, connection type, configuration, arrangement, and/or the like. In some embodiments wherein the keying member 38 is held by the housing 32 without being received within the groove 54 (e.g., when the housing 32 does not include the groove 54), the keying member 38 may be moveable relative to the housing 32 along the central longitudinal axis 45. Although the end portions 102 and 104 of the keying member body 100 are shown as including the gap G when the keying member 38 is mounted on the housing 32, alternatively the end portions 102 and 104 may be engaged when the keying member 38 is mounted on the housing 32.

Referring again to FIG. 2, the mating connector 18 includes the housing 60, a wire barrel 114, the electrical contact 88, the keying element 42, and the fastener element 98. The housing 60 includes a dielectric body 116 extending a length along a central longitudinal axis 118 from a mating end portion 120 to a cable end portion 122. A cavity 124 extends through the housing body 116 from the mating end portion 120 to the cable end portion 122. The cavity 124 is at least partially defined by an interior surface 126 of the housing body 116 that extends from the mating end portion 120 to the cable end portion 122. An optional wire seal (not shown) is received within the cavity 124 of the housing body 116 at the cable end portion 122 for sealing the cavity 124 at the cable end portion 122. Specifically, the wire seal engages the electrical cable 16 and the interior surface 126 of the housing body 116 to seal the electrical cable 16 to the housing 60 at the cable end portion 122 thereof. The housing 60 may be referred to herein as a "mating connector housing".

In the exemplary embodiment, the mating end portion 120 of the housing body 116 defines an opening 58 that is configured to receive at least a portion of the mating end portion 46 of the cable connector housing 32 therein. Alternatively, the mating end portion 120 of the housing body 116 defines a plug (not shown) that is configured to be received within an opening (not shown) of the cable connector housing 32.

Referring now to FIGS. 2 and 5, the mating end portion 120 of the housing body 116 includes the keying element 42. Specifically, in the exemplary embodiment, the keying element 42 includes the openings 112, which extend into the interior surface 126 of the housing body 116. Although shown as generally rectangular, each opening 112 may include any other size, shape, geometry, and/or the like, which may or may not be complementary with the corresponding extension 110 of the keying member 38. Although two openings 112 are shown, the keying element 42 may include any number of openings 112 for receiving any number of extensions 110 of the keying member 38.

Referring again to FIG. 2, the wire barrel 114 is held within the cavity 124 of the housing body 116 and includes an electrically conductive body 128 that extends from a cable end portion 130 to a contact end portion 132. The cable end portion 130 of the wire barrel 114 includes an opening 134 that receives an end portion 136 of the electrical conductor 28 therein such that the electrical conductor 28 is electrically connected to the wire barrel 114. The wire barrel 114 may be electrically and mechanically connected to the electrical conductor 28 using any structure, method, means, connection type, configuration, arrangement, and/or the like. In the exemplary embodiment, the cable end portion 130 of the wire barrel 114 is crimped about the end portion 136 of the electrical conductor 28 to electrically and mechanically connect the electrical conductor 28 to the wire barrel 114.

The contact end portion 132 of the wire barrel 114 includes an opening 138 that receives an end portion 140 of a receptacle assembly 142 therein. The wire barrel 114 may be held in the cavity 124 of the housing 60 using any structure, method, means, connection type, configuration, arrangement, and/or the like, such as, but not limited to, a snap fit connection, an interference (or clearance) fit connection, using any fastener(s) and/or any fastener element(s), and/or the like. In the exemplary embodiment, the contact end portion 132 of the wire barrel 114 is threadably connected to the interior surface 126 of the housing body 116 to hold the wire barrel 114 within the housing cavity 124.

The receptacle assembly 142 is held within the cavity 124 of the housing body 116 and includes an electrically conductive body 144 that extends from the end portion 140 to a mating end portion 146. The end portion 140 is held within the opening 138 of the wire barrel 114 such that the mating end portion 146 of the receptacle assembly 142 extends along the mating end portion 120 of the housing body 116. The end portion 140 may be held in the opening 138 of the wire barrel 114 using any structure, method, means, connection type, configuration, arrangement, and/or the like, such as, but not limited to, a snap fit connection, an interference (or clearance) fit connection, using any fastener(s) and/or any fastener element(s), welding, brazing, and/or the like. In the exemplary embodiment, the end portion 140 of the receptacle assembly 142 is brazed to the wire barrel 114 to hold the end portion 140 of the receptacle assembly 142 within the opening 138 of the wire barrel 114. In addition or alternatively to the connection between the receptacle assembly 142 and the wire barrel 114, the receptacle assembly 142 may be connected to the housing body 116 using any structure, method, means, connection type, configuration, arrangement, and/or the like, such as, but not limited to, a snap fit connection, an interference (or clearance) fit connection, using any fastener(s) and/or any fastener element(s), and/or the like.

The receptacle assembly body 144 includes the receptacle 94, which as described above receives the mating end portion 84 of the electrical contact 36 of the cable connector 14 therein to establish electrical connection between the connectors 14 and 18. The receptacle 94 also holds the optional support pin 92 and the electrical contact 88. The support pin 92 may be held in the receptacle 94 using any structure, method, means, connection type, configuration, arrangement, and/or the like, such as, but not limited to, a snap fit connection, an interference (or clearance) fit connection, using any fastener(s) and/or any fastener element(s), and/or the like. In the exemplary embodiment, the support pin 92 is threadably connected to the receptacle assembly body 144.

In the exemplary embodiment, the electrical contact 88 includes two louvertac bands 88*a* and 88*b* that surround the support pin 92. However, the electrical contact 88 may include any other size, shape, geometry, configuration, arrangement, structure, and/or the like that enables the electrical contact 88 to electrically connect to the electrical contact 36 of the cable connector 14. Moreover, the electrical contact 88 may be held in the receptacle 94 using any structure, method, means, connection type, configuration, arrangement, and/or the like, such as, but not limited to, a snap fit connection, an interference (or clearance) fit connection, using any fastener(s) and/or any fastener element(s), welding, brazing, and/or the like. In the exemplary embodiment, the electrical contact 88 is held within the receptacle 94 using an interference (or clearance) fit connection.

In the exemplary embodiment, the mating connector 18 includes one electrical contact 88 that conducts electrical power. However, the mating connector 18 may include any number of electrical contacts 88 that each may conduct electrical power, electrical signals, or electrical ground. In some alternative embodiments, the electrical contact(s) 88 may be replaced with one or more contacts that conduct something other than electrical power, electrical signals, and electrical ground, such as, but not limited to, one or more optical contacts.

The fastener element 98 facilitates mechanically holding the cable connector housing 32 and the mating connector housing 60 together. The fastener element 98 may be any type of fastener and/or fastener element. In the exemplary embodiment, the fastener element 98 is a thread that engages the thread 96 of the cable connector housing 32 to mechanically connect the housings 32 and 60 together. In addition or alternative to the fastener element 98, the housing 60 may include any other structure, method, means, connection type, configuration, arrangement, and/or the like for connection to the cable connector housing 32, such as, but not limited to, a snap fit connection, an interference (or clearance) fit connection, using any fastener(s) and/or any fastener element(s), and/or the like.

Figure 6:
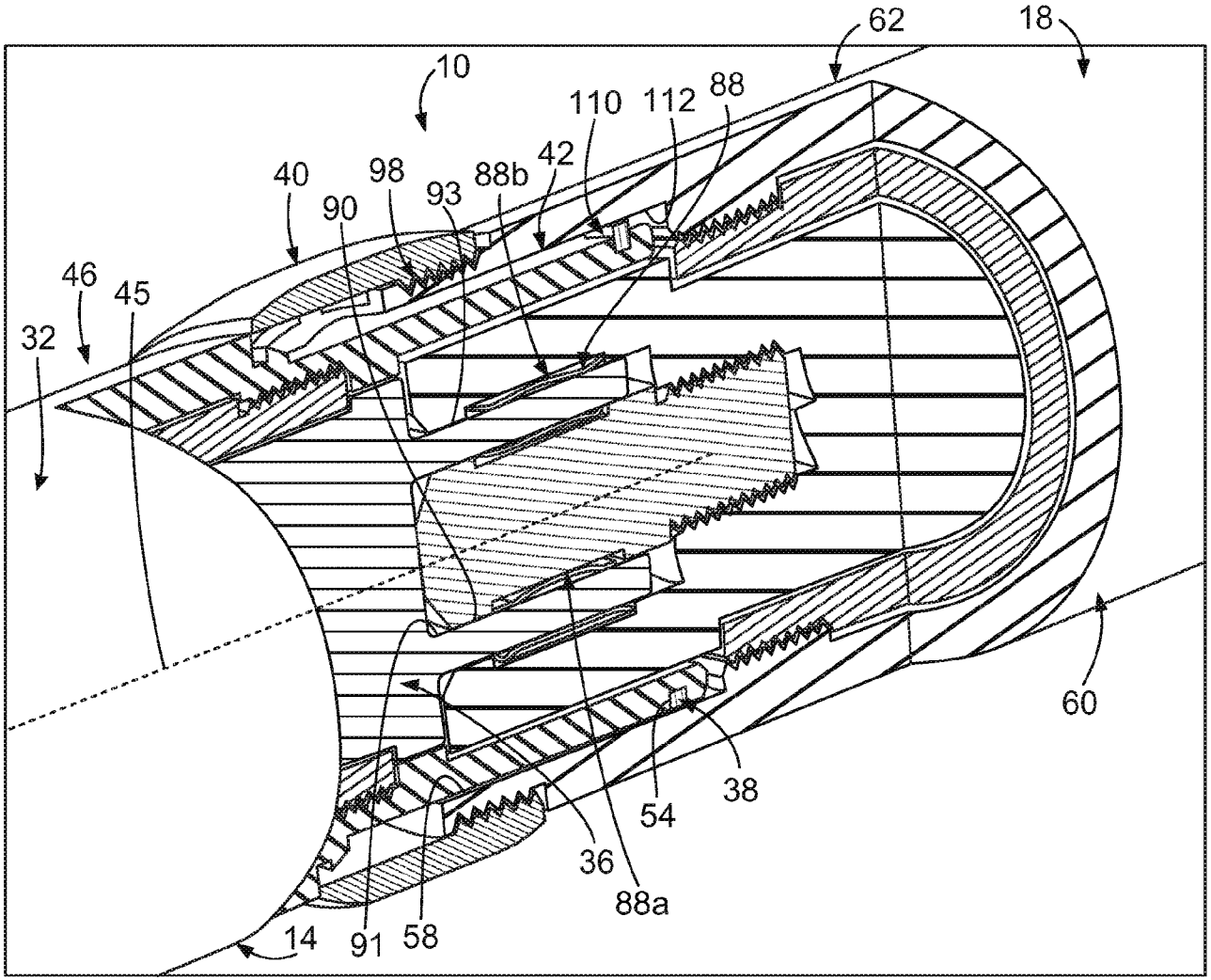
FIG. 6 is a cross-sectional view of a portion of the electrical connector assembly shown in FIGS. 1, 2, 4, and 5 illustrating the assembly in the mated state.

FIG. 6 is a cross-sectional view of a portion of the electrical connector assembly 10 illustrating the assembly 10 in the mated state. To mate the connectors 14 and 18 together, the mating end portions 46 and 62 of the housings 32 and 60, respectively, are positioned such that the mating end portions 46 and 62 oppose each other. The keying member 38 of the cable connector 14 is rotated within the groove 54 and about the central longitudinal axis 45 until each extension 110 of the keying member 38 is aligned with the corresponding opening 112 of the keying member 42 of the mating connector 18. If the extensions 110 were not aligned with the openings 112, the extensions 110 would interfere the mating end portion 62 of the mating connector housing 60 and thereby prevent the connectors 14 and 18 from being mated. Once the extensions 110 are aligned with the openings 112, the mating end portion 46 of the cable connector 14 is inserted into the opening 58 within the mating end portion 62 of the mating connector 18.

As the cable connector 14 is inserted into the mating connector 18, each extension 110 of the cable connector 14 is received within the corresponding opening 112 of the mating connector 18 to thereby enable the connectors 14 and 18 to be mated together. When mated together, the electrical contact 36 of the cable connector 14 is engaged with the electrical contact 88 of the mating connector 18 to establish an electrical connection between the connectors 14 and 18 and thereby between the cables 12 and 16. Specifically, the louvertac band 88*a* of the electrical contact 88 is received within the opening 90 of the electrical contact 36 such that the louvertac band 88*a* is engaged with a radially inner surface 91 of the electrical contact 36 that defines the opening 90. The louvertac band 88*b* of the electrical contact 88 engages a radially outer surface 93 of the electrical contact 36. Once mated, the fastener 40 of the cable connector 14 is threadably engaged with the fastener element 98 of the mating connector 18 to facilitate holding the connectors 14 and 18 together.

In the exemplary embodiment, the cable connector 14 includes the keying member 38 and the mating connector 18 includes the keying element 42. Alternatively, the cable connector 14 includes the keying element 42 and the mating connector 18 includes the keying member 38. Moreover, although the cable connector 14 includes the fastener 40 and the mating connector 18 includes the fastener element 98 in the exemplary embodiment, alternatively the cable connector 14 includes the fastener element 98 and the mating connector 18 includes the fastener 40.

Although the embodiments described and/or illustrated herein are described and illustrated herein with reference to electrical cables and electrical connectors, the embodiments described and/or illustrated herein are not limited to electrical connectors and electrical cables. Rather, the embodiments described and/or illustrated herein may be used with any type of connector and any type of cable, such as, but not limited to, optical connectors and optical cables, connectors and cables that transport fluid, and/or the like.

The embodiments described and/or illustrated herein provide a connector that terminates the end of a cable, wherein the connector may be more easily mated with a mating connector than at least some known connectors that terminate the end of a cable. The embodiments described and/or illustrated herein provide a connector that terminates the end of a cable, wherein the connector and/or the cable may be less likely to be damaged when orienting the connector relative to a mating connector. For example, the embodiments described and/or illustrated herein provide a connector that terminates the end of a cable, wherein the connector may be oriented relative to a mating connector without rotating a housing of the cable connector. Moreover, and for example, the embodiments described and/or illustrated herein provide a connector that terminates the end of a cable, wherein the connector may be oriented relative to a mating connector without twisting the cable.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector for terminating an end portion of a cable that includes a conductor, said connector assembly comprising: a housing; a contact held by the housing, the contact being configured to be connected to the conductor of the cable; and a keying member rotatably held by the housing, the keying member being configured to cooperate with a keying element of a mating connector that mates with the connector, wherein the keying member is movable about the housing such that the keying member is rotatably positioned to align with the keying element of the mating connector, wherein the housing comprises a groove, at least a portion of the keying member being received within the groove such that the keying member is movable within the groove, wherein the groove does not extend along a helical path along the housing.

2. The connector according to claim 1, wherein the housing extends a length along a central longitudinal axis, the keying member being rotatable about the central longitudinal axis.

3. The connector according to claim 1, wherein the housing comprises a continuous groove, at least a portion of the keying member being received within the groove such that the keying member is movable within the groove.

4. The connector according to claim 1, wherein the keying member comprises a ring that surrounds a portion of the housing, the ring comprising a pair of opposing end portions that are spaced apart from each other by a gap.

5. The connector according to claim 1, wherein the keying member comprises an extension that is configured to be received within an opening of the keying element of the mating connector.

6. The connector according to claim 1, wherein the keying member comprises a pair of opposing end portions, at least one of the end portions comprising an extension that is configured to be received within an opening of the keying element of the mating connector.

7. A connector for terminating an end portion of a cable that includes a conductor, said connector comprising:

a housing;

a contact held by the housing, the contact being configured to be connected to the conductor of the cable; and a keying member rotatably held by the housing and comprising an extension, the keying member being configured to cooperate with a keying element of a mating connector that mates with the connector, wherein the extension is movable about the housing such that the extension is rotatably positioned to align with the keying element of the mating connector.

8. A connector and cable assembly comprising: a cable comprising an end portion and a conductor extending along a length of the cable; and a connector terminating the end portion of the cable, the connector comprising: a housing;

a contact held by the housing, the contact being connected to the conductor of the cable; and a keying member rotatably held by the housing, the keying member being configured to cooperate with a keying element of a mating connector that mates with the connector, wherein the keying member is movable about the housing such that the keying member is rotatably positioned to align with the keying element of the mating connector, wherein the connector housing comprises a continuous groove, at least a portion of the keying member being received within the groove such that the keying member is movable within the groove.

9. The connector and cable assembly according to claim 8, wherein the housing extends a length along a central longitudinal axis, the keying member being rotatable about the central longitudinal axis.

10. The connector and cable assembly according to claim 8, wherein the housing comprises a groove, at least a portion of the keying member being received within the groove such that the keying member is movable within the groove, wherein the groove does not extend along a helical path along the housing.

11. The connector and cable assembly according to claim 8, wherein the keying member comprises a ring that surrounds at least a portion of the housing.

12. The connector and cable assembly according to claim 8, wherein the keying member comprises a ring that surrounds a portion of the housing, the ring comprising a pair of opposing end portions that are spaced apart from each other by a gap.

13. The connector and cable assembly according to claim 8, wherein the keying member comprises an extension, the extension being movable about the housing such that the extension is rotatably positioned to align with the keying element of the mating connector.

14. The connector and cable assembly according to claim 8, wherein the keying member comprises a pair of opposing end portions, at least one of the end portions comprising an extension that is configured to be received within an opening of the keying element of the mating connector.

15. A connector assembly comprising: a mating connector having a mating connector housing comprising a keying element; and a cable connector comprising a cable connector housing and a keying member rotatably held by the cable connector housing, the keying member and the keying element being configured to cooperate with each other to enable the cable connector and the mating connector to be mated together, wherein the keying member is rotatably movable about the cable connector housing such that the keying member is rotatably positioned to align with the keying element of the mating connector, wherein the keying member comprises a pair of opposing end portions, at least one of the end portions comprising an extension that is configured to be received within an opening of the keying element of the mating connector housing.

16. The connector assembly according to claim 15, wherein the cable connector housing comprises a continuous groove and extends a length along a central longitudinal axis, at least a portion of the keying member being received within the groove such that the keying member is rotatable about the central longitudinal axis.

17. The connector assembly according to claim 15, wherein the keying element comprises an opening and the keying member comprises an extension that is configured to be received within the opening.

18. The connector assembly according to claim 15, wherein the keying element is stationary relative to the mating connector housing.

* * * * *